US005277685A

United States Patent [19]

Gonzales

[11] Patent Number: 5,277,685

[45] Date of Patent: Jan. 11, 1994

[54] WHEELCHAIR OCCUPANT MOTION STABILIZER FOR EXERCISE MACHINES

[76] Inventor: Phillip Gonzales, 4157 Oliver St., Central Valley, Calif. 96019

[21] Appl. No.: 833,972

[22] Filed: Feb. 11, 1992

[51] Int. Cl.[5] ..... A63B 21/00

[52] U.S. Cl. ..... 482/134; 128/25 R

[58] Field of Search ..... 482/66, 69, 51, 133, 482/134, 142, 908, 139; 128/25 R; 128/845; 128/846

[56] References Cited

U.S. PATENT DOCUMENTS

| | | | |
|---|---|---|---|
| 2,718,396 | 9/1955 | Lateau et al. . | |
| 3,754,547 | 8/1973 | Walker | 128/25 R |
| 3,999,762 | 12/1976 | Castor . | |
| 4,153,244 | 5/1979 | Tauber, Jr. . | |
| 4,402,502 | 9/1983 | Peters . | |
| 4,411,424 | 10/1983 | Barnett | 482/139 X |
| 4,478,213 | 10/1984 | Redding | 128/25 R |
| 4,565,368 | 1/1986 | Boettcher | 482/134 |
| 4,572,501 | 2/1986 | Durham et al. | 128/25 R X |
| 4,732,379 | 3/1988 | Bodine-Reese et al. | 482/134 |
| 4,732,380 | 3/1988 | Maag | 482/134 |
| 4,732,381 | 3/1988 | Skowronski | 482/134 |
| 4,765,614 | 8/1988 | Shute . | |
| 4,787,375 | 11/1988 | Krause | 482/134 X |
| 4,883,268 | 11/1989 | Salkind . | |
| 4,898,381 | 2/1990 | Gordon | 482/900 X |
| 4,905,676 | 3/1990 | Bond et al. | 128/25 R |
| 4,911,435 | 3/1990 | Johns . | |
| 4,928,673 | 5/1990 | Heneger | 482/908 X |
| 5,004,230 | 4/1991 | Jones | 482/134 X |
| 5,044,629 | 9/1991 | Ryan et al. | 482/908 X |
| 5,100,128 | 3/1992 | Mabry et al. | 482/134 |
| 5,110,121 | 5/1992 | Foster | 128/25 R X |
| 5,123,886 | 6/1992 | Cook | 128/25 R X |

*Primary Examiner*—Robert Bahr
*Attorney, Agent, or Firm*—James M. Ritchey

[57] ABSTRACT

A motion stabilizing system, for use by a physically challenged wheelchair occupant, is disclosed. The motion stabilizing system limits undesirable movement of a wheelchair and the occupant during manipulations of an exercise machine associated with the system. Restricted by the motion stabilizing system are backward, forward, and upward motions of the wheelchair occupant during use of the exercise machine.

2 Claims, 5 Drawing Sheets

WHEELCHAIR OCCUPANT MOTION STABILIZER FOR EXERCISE MACHINES

BACKGROUND OF THE INVENTION

1. Field of the Invention

Generally, the subject apparatus relates to exercise machines employed by an operator to strengthen or limbering various body muscles and joints. Specifically, the subject apparatus discloses a motion stabilizing system that prevents undesirable movement by a wheelchair bound operator during use of an exercise or physical therapy machine.

2. Description of the Background Art

Traditional exercise or physical therapy devices that are used to improve a wheelchair bound operator's physical condition are generally of limited use. Usually, the operator must be removed from the wheelchair and placed onto a receiving seat (such movement is usually performed by an additional person) or the operator locks the wheelchair into a less than ideal position by applying the wheel associated brakes. Further, due to relatively free wheel rotation with a standard parked, brakes applied, wheelchair, the locked wheelchair wheels (locked to prevent normal rolling) have a tendency for the seat and frame to rock up and down or back and forth, relative to the locked wheels, especially when the occupant is involved in moderate to vigorous exercise. The subject device overcomes these difficulties by securely anchoring the wheelchair bound operator in a stable (limited forward, backward, and upward movements), ideal position for operating a wide variety of weight training machines.

Disclosed in U.S. Pat. No. 2,718,396 is a leg exercising attachment for a physically impaired individual's wheelchair. The device has a spring activated pedal for each foot and handle grips for the user to pull against. Two hook formations clip around the wheelchair's frame, proximate the wheel axles, to attach the device.

U.S. Pat. No. 3,999,762 relates an exercising machine for wheelchair confined persons in which the person wheels the chair into a receiving bay from which the person may then exercise with the machine. The device has sturdy frame members that permit the user to lift themselves into various exercise positions. No means are provided for securing the wheelchair within the apparatus.

A gymnastic set is provided for wheelchair patients in U.S. Pat. No. 4,153,244. A wheelchair is rolled backwards into the device and a foot or leg assembly is replace, thereby surrounding the wheelchair with a non-attached framework. Numerous exercise components are associated with the framework. Further, the framework is mounted on wheels for easy movement.

Made known in U.S. Pat. No. 4,402,502 is an exerciser for disabled persons. The motor driven exerciser has appliances for securing both arms and legs within receiving mountings. Both the arms and legs are moved by motor coupled pedals and handles. No means are supplied for securing the wheelchair to the device.

U.S. Pat. No. 4,765,614 presents an exercise machine for persons confined to a wheelchair. A receiving ramp mates with the chairs wheels and then rocks back into an inclined position, thereby forcing, by gravity, the user's back against a slanted backrest. Pneumatically controlled resistance members are included for exercise use by the wheelchair occupant.

A compact, portable, rowing type exercise apparatus is described in U.S. Pat. No. 4,883,268. The device is usable by a wheelchair seated exerciser. An elongated lower support is positioned with one end between the wheelchair's wheels and the other end extending in front of the chair. The end in front of the chair has a pneumatically activated rowing assembly that projects upward in front of the wheelchair occupant.

Finally, U.S. Pat. No. 4,911,435 provides exercise machinery that is convertible between non-wheelchair and wheelchair bound individuals. Various machines are described, but all have a removable seat assembly, used by non-wheelchair bound person, and a ramp assembly, used for receiving the wheels of the wheelchair bound person's wheelchair. Provided are wheelchair securement straps that extend between the exercise machine and the locked wheelchair wheels. The machine attached body straps serve for both types of individuals.

SUMMARY OF THE INVENTION

An object of the present invention is to provide a device that may be employed solely by a physically challenged occupant of a wheelchair during use of an exercise machine to prevent movement of the occupant during exercise with the machine.

Another object of the present invention is to produce a wheelchair motion stabilizer that limits the amount of forward, backward, and upward motions of the wheelchair and occupant during exercise.

A further object of the present invention is to present an exercise machine that is adapted with a wheelchair motion stabilizer system that is readily accessible and simple to use by a wheelchair occupant and limits the forward, backward, and upward motions of the occupant during exercise.

Still another object of the present invention is to produce a wheelchair motion stabilizer system that does not require that the adapted exercise machine have wheelchair wheel receiving ramps.

Disclosed is a wheelchair motion stabilizing system, for use by a physically challenged wheelchair occupant. The motion stabilizing system limits undesirable movement of a wheelchair and the occupant during manipulations of an exercise machine associated with the system. Restricted by the motion stabilizing system are backward motions, by means of an adjustable backrest assemblage, and combined forward, and upward motions, by means of an adjustable lap bar assemblage.

Other objects, advantages, and novel features of the present invention will become apparent from the detailed description that follows, when considered in conjunction with the associated drawings.

DESCRIPTION OF THE PREFERRED EMBODIMENT

Figure 1:
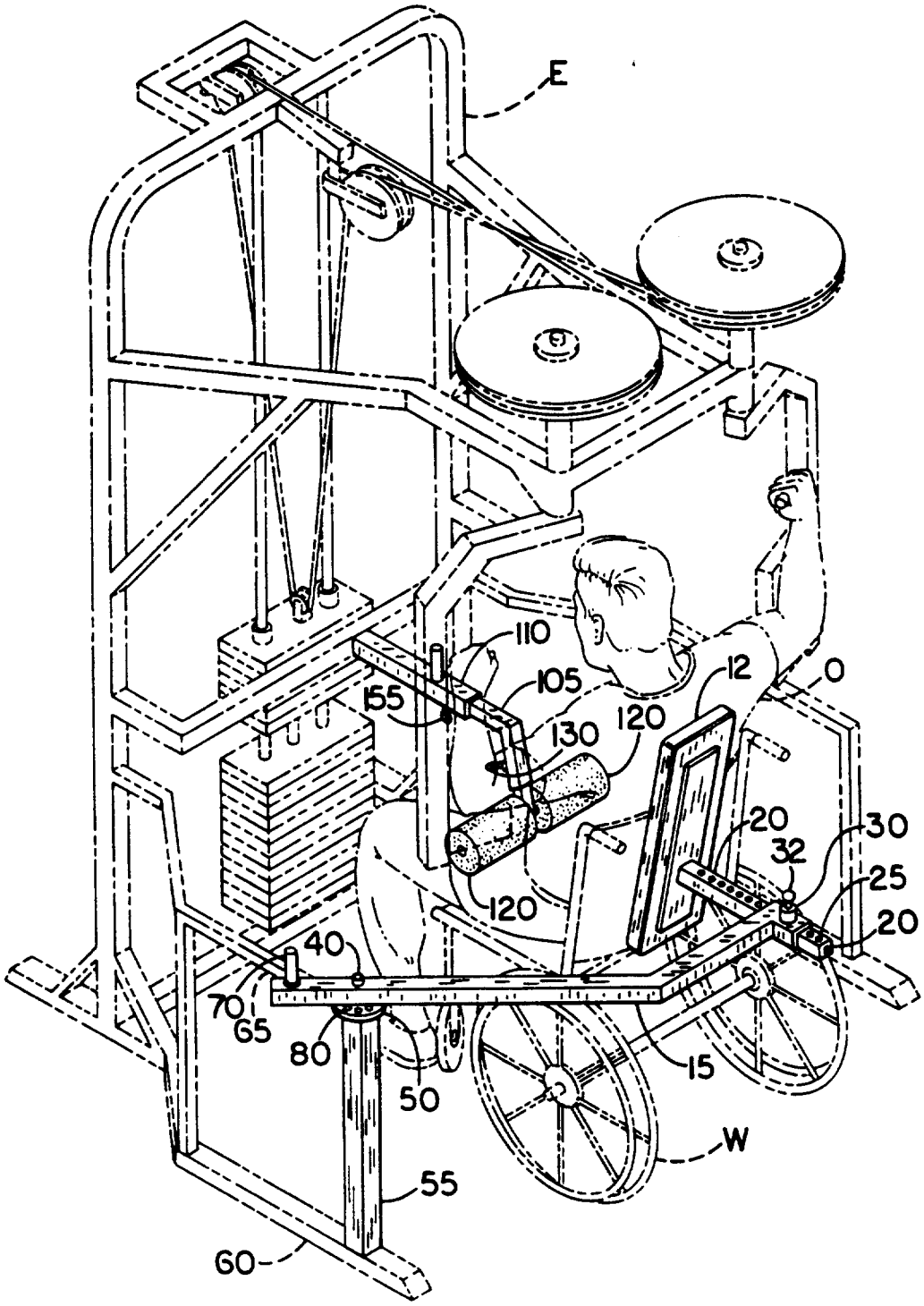
FIG. 1 is a perspective view of the subject system showing a wheelchair occupant positioned between the backward motion prevention means and the forward and upward motions prevention means.
Figure 2:
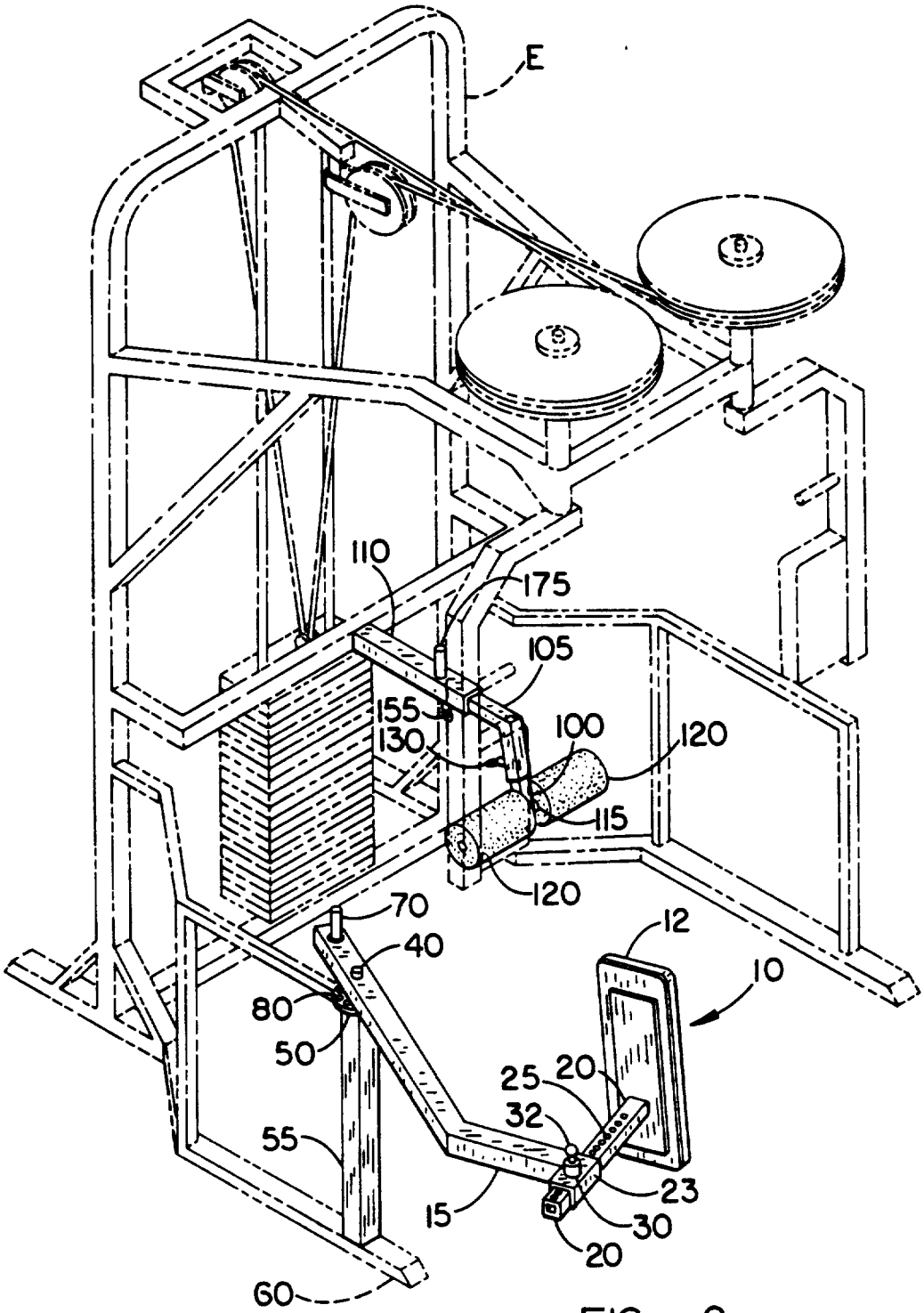
FIG. 2 is a perspective view of the subject system, without a user present, having the arm portion of the backward motion prevention means pivoted into a location that permits a wheelchair to enter the adapted exercise machine.
Figure 5:
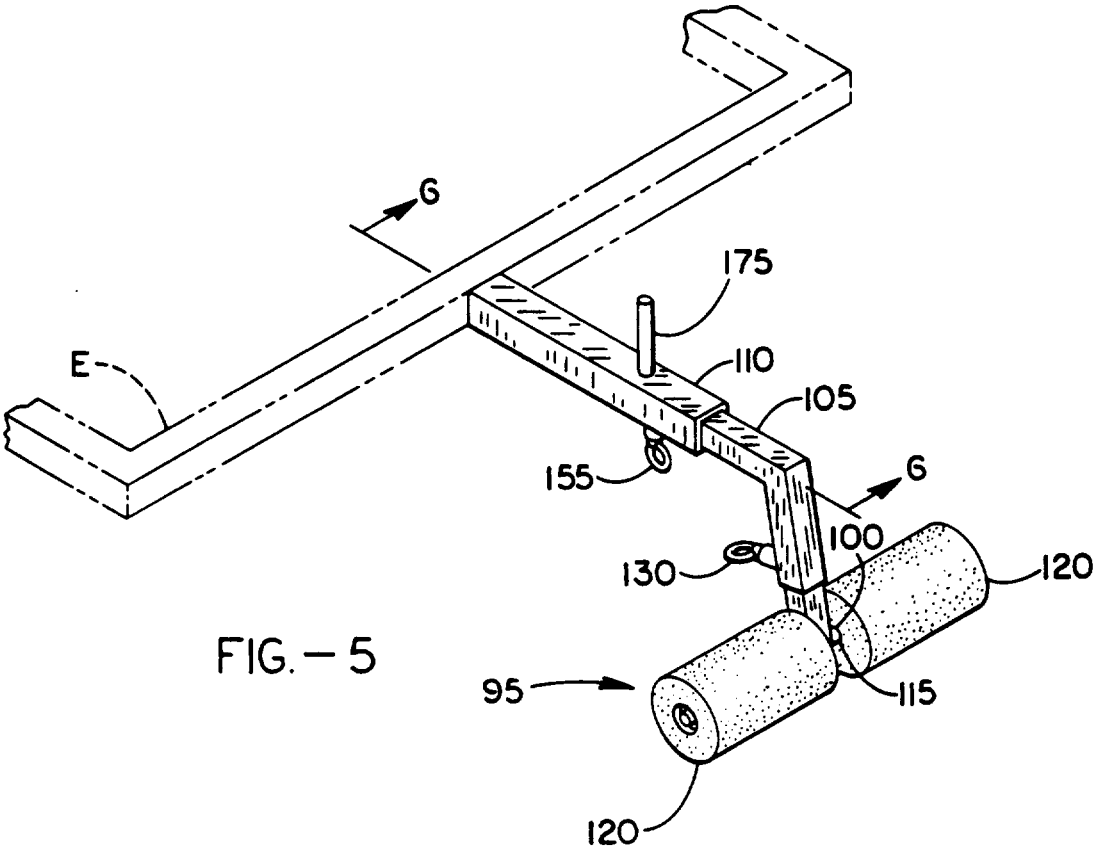
FIG. 5 is a perspective view only of the forward and upward motions prevention means of the subject system.

Referring now to FIGS. 1-6, there is shown a preferred embodiment of a motion stabilizer system for limiting undesirable movements of both a wheelchair W and a wheelchair occupant O during exercises involving manipulating an exercise machine E adapted with the subject system. Most exercise machines are adaptable with the subject system. FIGS. 1 and 2 depict an exercise machine E designed to strengthen the wheelchair occupant's upper body, however, this exercise machine E is only representative of numerous types of suitable exercise devices that are readily adaptable with the subject system. The exact changes to the structural configuration of a particular exercise machine to be adapted for use with the subject system are standard procedures, well known to those skilled in the appropriate fabrication arts. For modifying a standard exercise machine (with the term "standard" implying a machine that traditionally is used by an operator not in a wheelchair), such modifications as removing the normal seat and altering the structure to receive the subject system are easily accomplished by cutting, welding, and like techniques.

To properly employ an exercise machine E adapted for wheelchair use an operator O needs to be able to have a relatively fixed position from which to work. A relatively fixed exercise position restricts upward (out of the wheelchair), forward (towards the machine), and backward (away from the machine) motions. Further, for multiple user to operate the exercise machine E the relatively fixed position must be somewhat adjustable to accept different individuals, wheelchairs, and like considerations. Thus, generally, the subject motion stabilizer system comprises two central elements. First, provided are means for preventing backward motion of the wheelchair and wheelchair occupant during exercise (see FIGS. 3 and 4). Second, provided are means for preventing both forward and upward motions of the wheelchair and wheelchair occupant during exercise (see FIGS. 5 and 6).

Comprising the backward motion prevention means is a backrest 10 that is adjustably secured to a portion of the exercise machine E. The backrest 10 usually has a cushioned pad 12 associated with its front surface. Included in the adjustable nature of the backrest connection are means providing the ability for the backrest 10 to be moved into a location that permits the wheelchair occupant O to roll the wheelchair W close to the exercise machine E and then reposition the backrest 10 into its exercise position. Further, means, associated with the backrest 10, are provided for locking the backrest 10 into the exercise position. Also, means, associated with the backrest 10, are included for positioning the wheelchair occupant O closer to or further from the exercise machine E.

Specifically, the backward motion prevention means includes a pivoting arm 15 having first and second ends. Secured or coupled to the second end of the pivoting arm 15 is the backrest 10. Usually, the connection between the backrest 10 and second end of the pivoting arm 15 includes means for incrementally adjusting the backrest 10 closer to or further from the machine. The incremental adjusting is usually accomplished by including an adjustable fitting. When the backrest 10 is in the exercise position the incremental adjustments of the adjustable fitting help customize the fit of the system to an individual user. Normally, although equivalent means are considered to be within the realm of this disclosure, the closer to and further from motion of the backrest 10 adjustable fitting is accomplished by including a sliding joint (see FIGS. 1-3) comprising a male backrest adjust component 20 and female backrest adjust component 23. The male backrest adjust component is secured to the rear of the backrest 10 and has a plurality of openings 25 for interacting with a first locking pin mechanism 30. Although the internal details of the first locking pin mechanism 30 are not depicted (however, see below for details of similar or identical second 125 and third 150 locking pin mechanisms), a standard construction is envisioned. Typically, the first locking pin mechanism 30 comprises a first knob 32 for grasping by the operator, a first locking pin for insertion into an opening 25, and usually, resilient means (commonly a suitable spring) within the mechanism 30 for holding the pin within the opening 25.

Figure 3:
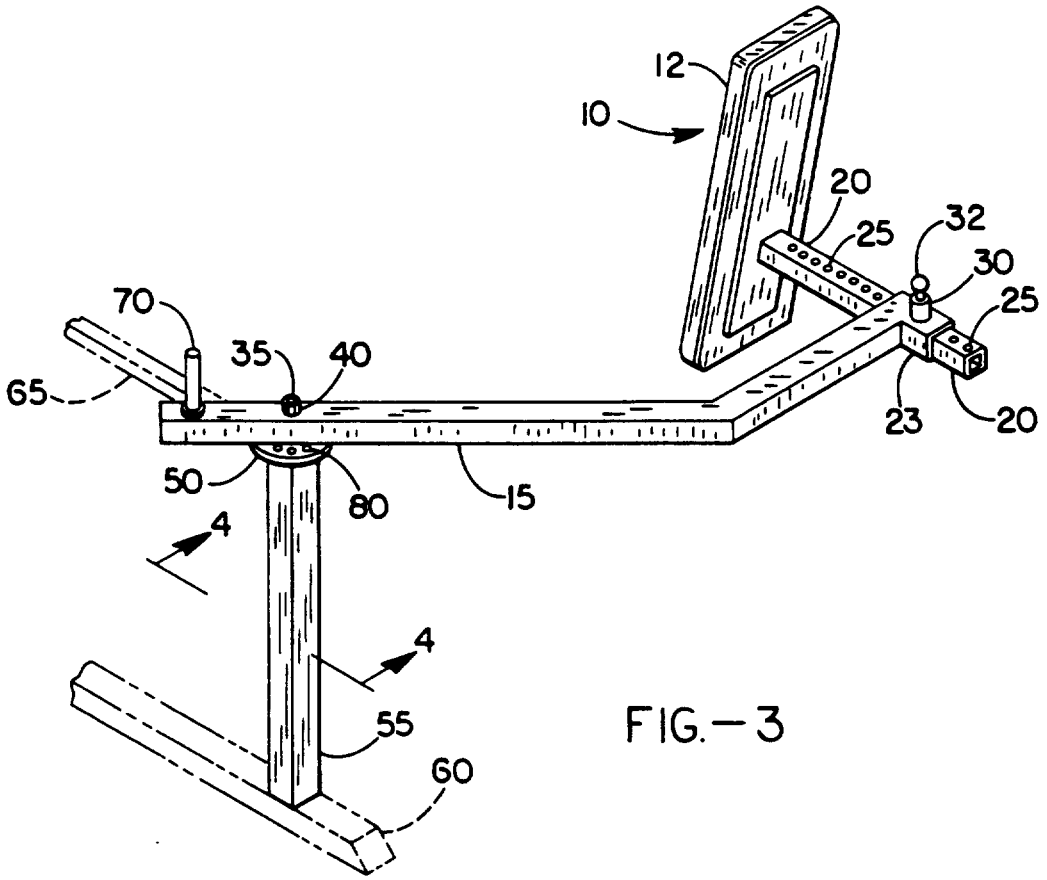
FIG. 3 is a perspective view only of the backward motion prevention means of the subject system.
Figure 4:
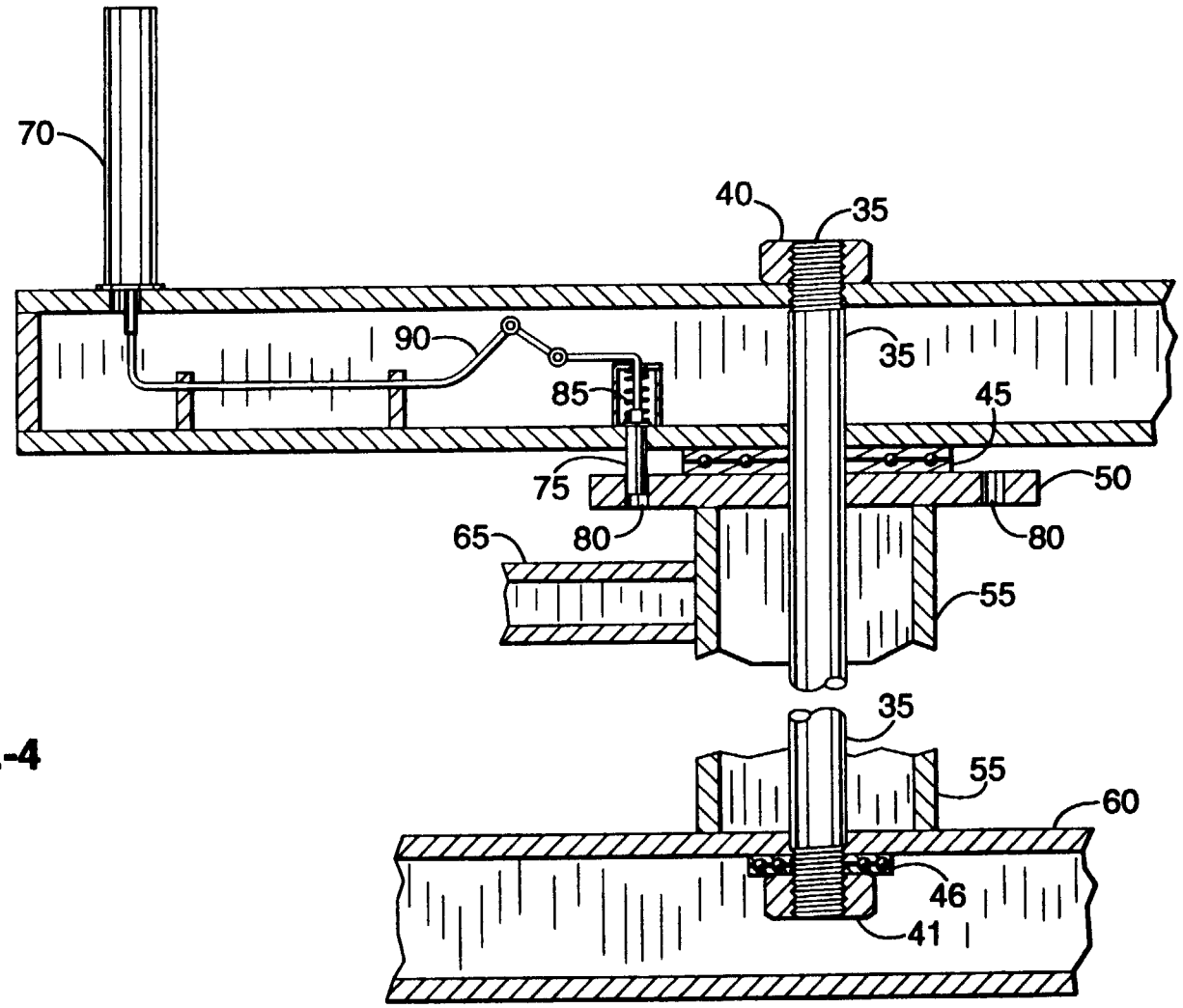
FIG. 4 is a cross sectional view taken along line 4—4 in FIG. 3.
Figure 6:
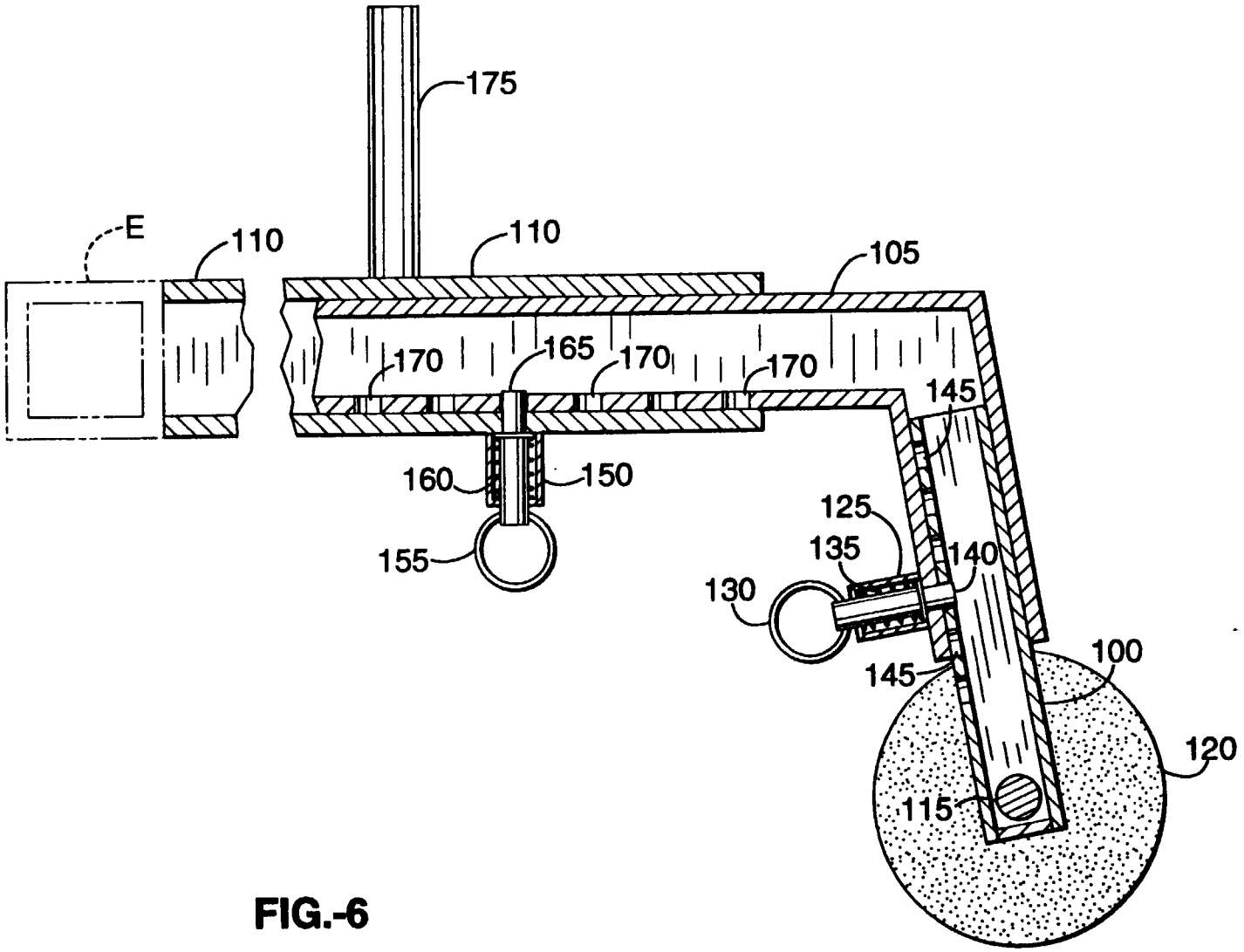
FIG. 6 is a cross sectional view taken along line 6—6 in FIG. 5.

The pivoting arm 15 swings or pivots into and out of the exercise position, as determined by the wishes of the wheelchair occupant O. After the wheelchair is rolled into the receiving machine E the backrest 10 then is pivoted into the exercise position behind the occupant O and, generally, the back support of the wheelchair W. To generate such pivoting capabilities, pivot attachment means are provided. As depicted in FIGS. 3 and 4, these pivot attachment means comprise a central axle 35 having threaded opposing ends, locking nuts 40 and 41, and appropriately placed bearings 45 and 46 that facilitate the pivoting action. The threaded axle 35 penetrates the pivoting arm 15 and is secured by means of a top locking nut 40. Permitting the pivoting arm 15 to rotate over a rotation plate 50, fastened on an underlying supporting member 55, is an upper bearing 45. The axle 35 passes through the rotation plate 50 and the length of the supporting member 55 and is secured below by a bottom locking nut 41 that holds the bottom bearings 46 in place.

Depending on the structural framework of the associated exercise machine, the supporting member 55 is of variable dimensions and configuration that fits appropriate attachment requirements of the selected exercise machine. As seen in FIGS. 1-4, the supporting member 55 is generally elongated and anchored to the exercise machine E via a lower brace or leg 60 and an upper brace 65. As indicated, the particular supporting framework varies with the nature of the exercise machine to which the subject invention is attached.

Pivot locking means are provided to secure the pivoting arm 15 in the exercise position. Comprising the pivot locking means is a first handle 70 attached proximate the pivoting arms 15 first end. The first handle 70 is secured to the pivoting arm 15 in a suitable manner to permit proper functioning of the first handle 70. The first handle 70 is accessible by the wheelchair occupant O and has two main functions. First, the handle 70 permits the occupant O to pivot the arm 15 into and out of the exercise position. Second, when activated by the occupant O, the handle 70 locks the arm 15 into and releases the arm 15 from the exercise position. Although equivalent means are considered to be within the scope of this disclosure, as illustrated in FIG. 4, a latch bolt 75 fits within a receiving aperture 80 in the rotation plate 50. The latch bolt 75 is housed or held in an assembly that usually includes resilient means 85, generally an appropriately fastened spring, that forces the latch bolt 75 into the receiving aperture 80 to secure the pivoting arm 15 in the exercise position. Although only one receiving aperture 80 is depicted in FIG. 4, to accommodate multiple pivotal positions for the pivoting arm 15, a plurality of receiving apertures 80 may be included in the rotation plate 50. Running between and coupling the first handle 70 with the latch bolt 75 is an appropriately configured linkage 90. Various equivalent and suitable linkages can be fabricated to function for withdrawing and inserting the latch bolt 75 in the aperture 80. The linkage 90, in FIG. 4, shows a simple series of supported members running from the first handle 70 to the latch bolt 75. When the first handle 70 is moved, usually by sliding (or equivalent motions), the latch bolt 75 is withdrawn from the receiving aperture 80. As indicated, other equivalent linkage means may replace this particular design and be within the sphere of this disclosure.

The second main feature of the subject system comprises the forward and upward motion prevention means. The forward and upward motion prevention means functions to restrict the occupant's O movements out of or away from the wheelchair W seat. As clearly rendered in FIGS. 5 and 6, the forward and upward motion prevention means includes a lap bar 95 assembly and means for attaching the lap bar assembly 95 to the exercise machine E. Preferably, the lap bar assembly 95 is attached to the exercise machine E via a set telescoping components. Usually, the telescoping component set comprises first 100, second 105 and third 110 members, each having first and second ends. Preferably, the lap bar assembly 95 comprises a two ended lap bar rod 115 and a two section lap bar pad 120. One lap pad 120 is secured to each end of the lap bar pad 115.

The first telescoping member's 100 first end is attached, by standard means, to the lap bar rod 115. Slidably inserted or mated within the second telescoping member's first end is the first telescoping member's second end. Reversibly locking the first and second telescoping members 100 and 105 together is a second locking pin mechanism 125, similar or identical to the first locking pin mechanism 30. Comprising the second locking pin mechanism 125 are a second knob 130, a second resilient means 135, and a second pin 140. To secure the first telescoping member 100 within the second telescoping member 105, the second pin 140 fits into one of a plurality of first telescoping member apertures 145. Further, to facilitate the positioning of the lap bar pad 120 close to the occupant's lap, the second telescoping members has a bend that directs its first end down and towards the lap of the occupant.

Within the third telescoping member's 110 first end is inserted or mated the second telescoping member's 105 second end. In analogous fashion with the connection between the first 100 and second 105 telescoping members connection, a third locking pin mechanism 150 reversibly secures the two together. Comprising the third locking pin mechanism 150 are a third knob 155, a third resilient means, and a third locking pin 165. The third locking pin 165 fits within one aperture 170 of a plurality of apertures 170 in the third telescoping member 110.

The second end of the third telescoping member 110 is appropriately anchored to the framework of the exercise machine E. As with the pivoting arm assembly, the manner and method in which the third telescoping member 110 is attached to the exercise machine is not critical to the subject invention. As seen in FIGS. 1, 2, 5, and 6 the attachment is via a frame member connected to exercise machine.

Associated with the third telescoping member 110 is a second handle 175. The second handle 175 is accessible by the wheelchair occupant O for use is assisting the occupant O in positioning the wheelchair W and the occupant O is a desired location for exercise. The second handle 175 is fabricated from rigid materials and, usually, fitted with a soft or padded coating for cushioning. Attachment of the second handle 175 to the third telescoping member 110 is by standard means such as welding, bolting, and the like.

A physically challenged wheelchair bound occupant O utilizes the subject system by approaching the adapted exercise machine E in their wheelchair. The pivoting arm 15 is rotated to permit access into the area for receiving the wheelchair. Since the first handle 70 is within reach of the wheelchair occupant O, the occupant O grasps the first handle and swings the pivoting arm 15 into exercise position. Should the backrest 10 need to be adjusted closer or further away from the machine E the occupant can make these adjustments. Once within the exercise machine E, with the backrest 10 in place the lap bar assembly 95 is positioned by telescoping the members 100, 105, 110 into a desired configuration and locking them with the second 125 and third 150 locking pin mechanisms. To exit the adapted exercise machine E the wheelchair bound user O merely grasps the first handle 70, releases the latch bolt 75, swings the pivoting arm 15 out of the exercise position, and rolls the wheelchair W backwards from the machine E.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. For use by a physically challenged wheelchair occupant, a motion stabilizing system for limiting undesirable movement of a wheelchair and the occupant during manipulation of an exercise machine connected to said system, comprising:

a) a forward entering wheelchair accessible exercise machine;

b) means for preventing backward motion of the wheelchair occupant during said exercise machine use; and c) means for preventing both forward and upward motions of the wheelchair occupant during said exercise machine use, wherein said forward and upward motion prevention means comprises:

a lap bar and telescoping means attached to and between said lap bar and said exercise machine for adjusting the position of said lap bar against a lap of the wheelchair occupant, wherein said adjustable telescoping means comprises:

a first telescopic member having first and second ends, wherein said first end is attached to said lap bar;

a second telescopic member having first and second ends, wherein said second telescopic member first end telescopically mates with said first telescopic member second end;

means for securing the mating of said first telescopic member to said second telescopic member at a selected position;

a third telescoping member having first and second ends, wherein said third telescoping member first end telescopically mates with said second telescoping second end and said third telescoping member first end is secured to said exercise machine; and means for securing the mating of said second telescopic member to said third telescopic member at a selected position.

2. For use by a physically challenged wheelchair occupant, a motion stabilizing system for limiting undesirable movement of a wheelchair and the occupant during manipulation of an exercise machine connected to said system, comprising:

a) a forward entering wheelchair accessible exercise machine adapted to receive said motion stabilizing system;

b) means for preventing backward motion of the wheelchair occupant during said exercise machine use; and c) means for preventing both forward and upward motions of the wheelchair occupant during said exercise machine use, wherein said forward and upward motion prevention means comprises:

a lap bar and telescoping means attached to and between said lap bar and said exercise machine for adjusting the position of said lap bar against a lap of the wheelchair occupant, wherein said adjustable telescoping means comprises:

a first telescopic member having first and second ends, wherein said first end is attached to said lap bar;

a second telescopic member having first and second ends, wherein said second telescopic member first end telescopically mates with said first telescopic member second end;

means for securing the mating of said first telescopic member to said second telescopic member at a selected position;

a third telescoping member having first and second ends, wherein said third telescoping member first end telescopically mates with said second telescoping second end and said third telescoping member first end is secured to said exercise machine; and means for securing the mating of said second telescopic member to said third telescopic member at a selected position.

* * * * *